United States Patent [19]

Brimhall et al.

[11] Patent Number: 4,874,358

[45] Date of Patent: Oct. 17, 1989

[54] DUAL AXIS CONTINUOUS FLOW CENTRIFUGATION APPARATUS AND METHOD

[75] Inventors: Owen D. Brimhall, West Valley City; Stephen C. Peterson, Salt Lake City; Oleg Kotlyar, Salt Lake City; Dilip N. Ghosh Roy, Salt Lake City, all of Utah

[73] Assignee: Utah Bioreseach, Inc., Salt Lake City, Utah

[21] Appl. No.: 305,528

[22] Filed: Feb. 1, 1989

[51] Int. Cl.[4] ..... B04B 5/00; B04B 9/00

[52] U.S. Cl. ..... 494/37; 494/18; 494/19

[58] Field of Search ..... 494/18, 17, 16, 19, 494/21, 37, 43, 85, 31, 32, 33; 210/781, 782, 360.1; 422/72

[56] References Cited

U.S. PATENT DOCUMENTS 4,113,173 9/1978 Lolachi ..... 494/18
4,114,802 9/1978 Brown ..... 494/18
4,296,882 10/1981 Kobayashi ..... 494/18
4,372,484 2/1983 Larsson ..... 494/18
4,425,112 1/1984 Ito ..... 494/18

*Primary Examiner*—Robert W. Jenkins
*Attorney, Agent, or Firm*—J. Winslow Young

[57] ABSTRACT

This invention is a dual axis, continuous flow centrifuge apparatus and method. A centrifuge head rotates in a vertical orientation about a first axis which, in turn, is rotated in a horizontal plane about a second axis. The rotation of the centrifuge head is matched to the rotation of the second axis to cancel out any net rotation of flexible conduits attached to the centrifuge head. The nonrotating coupling of the conduits permits continuous flow through the centrifuge head in the absence of seals. An angled centrifuge chamber inside the centrifuge head provides a more rapid separation of the components in the liquid passing through the centrifuge head. The path of travel of a particle in a centrifuge chamber inside the centrifuge head follows a generally cycloidal path thereby undergoing a pulsatile centrifugal force component.

12 Claims, 2 Drawing Sheets

DUAL AXIS CONTINUOUS FLOW CENTRIFUGATION APPARATUS AND METHOD

BACKGROUND

1. Field of the Invention

This invention relates to continuous flow centrifugation apparatus and, more particularly, to a continuous flow centrifugation apparatus and method having a pulsatile component, the centrifuge rotor being mounted on a horizontally rotating arm, the rotation rate of which matches the rotation rate of the centrifuge rotor thereby allowing for a sealless coupling for the fluid conduits.

2. The Prior Art

Centrifugation is a well-known technique for separating liquid-liquid constituents of different densities or liquid-particulate suspensions. Customarily centrifugation of a liquid is conducted on a batch basis because of the difficulties encountered using seals necessary under conditions of continuous flow. Seals are not only difficult to manufacture with the necessary degree of accuracy but are expensive and can be the source of leakage as well as contamination or even stagnation. This is particularly important in the centrifugation of blood to obtain its fractions since blood is highly susceptible to contamination and stagnation in the vicinity of the seals.

Prior art devices designed to provide a continuous flow centrifugation head without seals involve rotating the centrifuge head about the vertical axis while matching the rotation of the centrifuge head. The matching of rotation rate means that there is no net rotation between the flexible conduits and the centrifuge head. Representative systems are shown in the following U.S. Pat. Nos.: 3,986,442; 4,111,356; 4,113,173; 4,114,802; 4,163,519; 4,221,322; 4,230,263; 4,296,882; 4,372,484; 4,425,112; 4,439,178; and 4,540,397. Similar features for electrical connections are shown in U.S. Pat. Nos. 3,586,413 and 3,984,164. Each of these prior art, continuous flow centrifugation apparatus involve a centrifuge head that spins about a vertical axis with the centrifugal forces disposed in an horizontal direction. These forces are continuous or in a steady state condition unless the speed of rotation of the centrifuge head is changed during the processing cycle.

In view of the foregoing, it would be an advancement in the art to provide a continuous flow centrifugation apparatus wherein changes are made in the force field imposed on the liquid, the changes causing improved separation of the liquid or particulate constituents in the liquid. It would also be an advancement in the art to provide a dual axis, continuous flow centrifugation apparatus and method. Such a novel invention is disclosed and claimed herein.

BRIEF SUMMARY AND OBJECTS OF THE INVENTION

This invention is a dual axis, continuous flow, pulsatile force, centrifugation apparatus and method. The centrifuge head rotates in a vertical orientation about an horizontal axis as the horizontal axis is turned about a vertical axis. The rate of rotation of the centrifuge head matches the rate of rotation of the centrifuge head about the vertical axis so that there is no net rotation of flexible conduits connected to the centrifuge head. Fluids passing through the centrifuge head are subjected to a pulsatile force field as a function of the location of the fluid in the centrifuge head as the centrifuge head rotates about its own axis while being turned in a circular path about the vertical axis.

It is, therefore, a primary object of this invention to provide improvements in continuous flow centrifugation apparatus.

Another object of this invention is to provide improvements in the method of subjecting liquids and particulates suspended in a liquid to centrifugation during continuous flow.

Another object of this invention is to provide a dual axis centrifugation apparatus wherein the liquid and/or particulates undergoing centrifugation are subjected to centrifugal forces along two axes.

Another object of this invention is to provide a continuous flow centrifugation apparatus wherein the liquid and/or particulates undergoing centrifugation are subjected to pulsatile changes in the centrifugal force fields.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
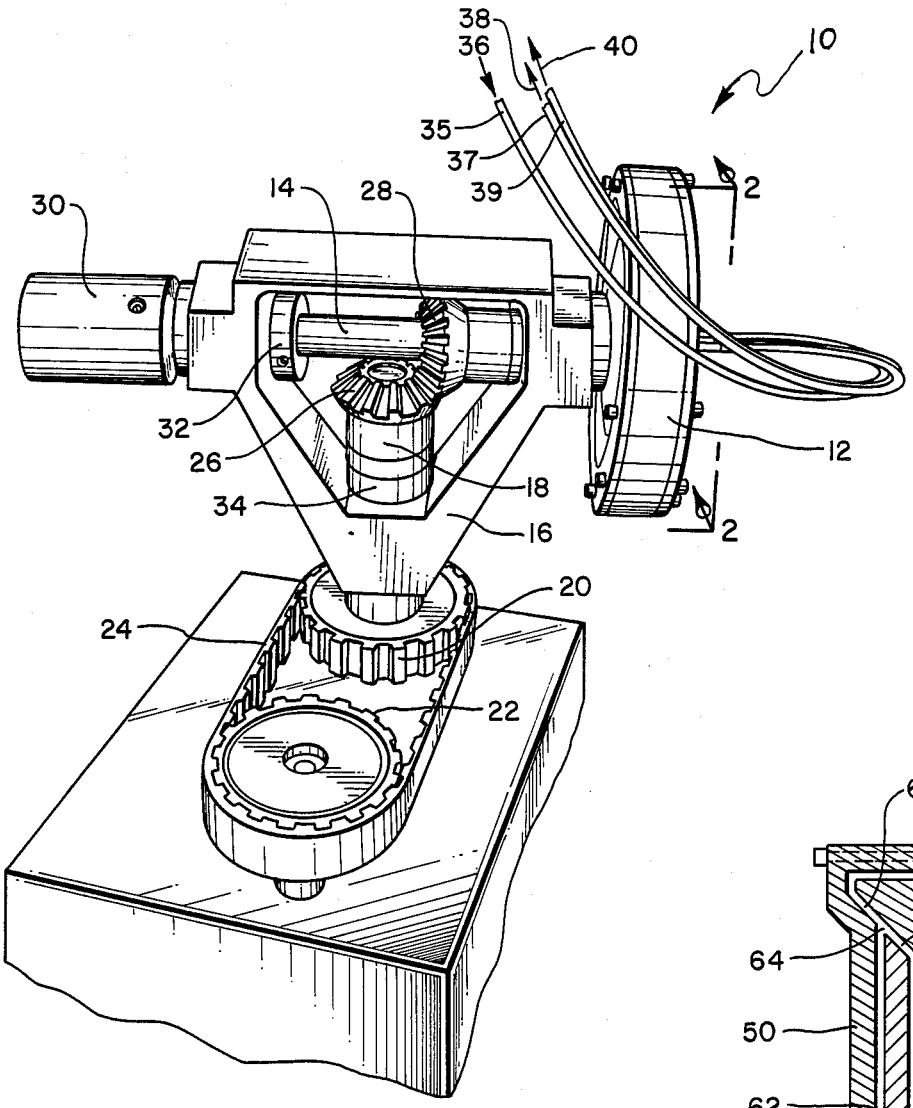
FIG. 1 is a perspective view of the dual axis, continuous flow centrifugation apparatus of this invention.

The invention is best understood by reference to the drawing wherein like parts are designated by like numerals throughout in conjunction with the following description.

GENERAL DISCUSSION

Centrifugation, or more particularly, the rate of particle sedimentation during centrifugation is significantly enhanced if the centrifugation chamber is offset angularly from the plane of rotation of the centrifuge. Spherical particle motion in a centrifuge tube can be described by equating drag force and buoyant force. Drag forces are described by Stoke's Law;

$$F_s = 6\pi_Z R v \qquad \text{Equation 1}$$

Where eta is the viscosity of the suspending fluid, R is the particle radius and v is the particle velocity in the direction of the acceleration.

The buoyant force on a particle is given by;

$$F_B = 4\pi R^3/3G(\rho_p - \rho_\epsilon) \qquad \text{Equation 2}$$

where G is the local acceleration, $\rho_p$ is the particle density and $\rho_f$ is the fluid density. The local acceleration (disregarding gravity) is given by $G=\omega^2 2r$, where $\omega$ is the radian velocity and r is the distance between the particle and the axis of rotation. Since $v=dr/dt$ we can rearrange and integrate to obtain;

$$t = 9/23\omega^2 R^2(\rho_p - \rho_\epsilon)\ L_n r2/r1 \qquad \text{Equation 3}$$

where r1 and r2 are distances from the axis of rotation between which the particle moves in time t (r2 is larger than r1). Note that the time of travel increases only logarithmically with distance because the local acceleration increases with r. Equation 1 predicts relatively rapid sedimentation times for whole blood although blood cell-blood cell interactions, nonspheroidal blood cell shape and other hydrodynamic factors combine to produce relatively long, real life sedimentation times. However, during centrifugation where the liquid passes through a centrifugation chamber that is configured as a relatively thin chamber being at an angular offset from the axis of rotation of the centrifuge, particle agglomeration and sedimentation is achieved quite rapidly and at lower angular velocities. In an angled centrifuge chamber, the maximum distance a cell can travel is close to the width of the centrifuge chamber. This means that the cells are rapidly agglomerated against the chamber wall so that the actual sedimentation rate is significantly increased. The aggregate slurry or agglomerated cells move downwardly through the angled centrifugation chamber under the action of tangential forces. The resulting sedimentation of the aggregate occurs quite quickly because of its effective larger size (larger than a single cell).

Continuous flow through the centrifuge apparatus is achieved by using a dual axis system whereby the rate of rotation of the centrifuge head about a first axis is matched by the rate of rotation of the first axis about a second axis. The matching rates of rotation means that flexible conduits connected to the centrifuge head will experience a zero net rotation thereby avoiding twisting of the conduits and eliminating entirely any requirement for seals which would otherwise be required if there were a net rotation between the fixed end of the conduit and the centrifuge head.

As pointed out previously in the introductory portion, various dual axis devices are disclosed in the prior art. However, a careful examination of each of these references will show that they all involve the centrifuge head portion of the apparatus rotating in an horizontal plane about a vertical axis. None of these references either disclose or suggest a centrifuge head rotating in a vertical plane about a first, horizontal axis while the horizontal axis rotates in a horizontal plane about a second, vertical axis. Surprisingly we have found that continuous flow, dual axis centrifugation with the apparatus of this invention provides improved separation through sedimentation under centrifugation. In particular, the liquid undergoing centrifugation has imposed thereon a centrifugal force having a generally pulsatile component. This pulsatile component is created by the fact that the centrifuge chamber is being rotated about the second axis so that a single point in the centrifuge chamber (rotating about the first axis) circumscribes a generally cycloid path in the cylindrical surface defined by the path of the centrifuge head about the second axis. Movement of this single spot outwardly through the angled centrifuge chamber imposes a pulsatile component to the centrifugal force imposed thereon.

DETAILED DESCRIPTION

Referring now more particularly to FIG. 1, a first preferred embodiment of the novel dual axis, continuous flow centrifugation apparatus of this invention is shown generally at 10 and includes a centrifuge head 12 mounted on a horizontal axle 14 which is rotatably mounted in a yoke 16. A vertical axle 18 passes upwardly through the vertical axis of rotation of yoke 16. A yoke gear 20 on yoke 16 is coupled to a drive gear 22 by a drive belt 24. A bevel gear 26 on the end of vertical axle 18 meshes with a corresponding bevel gear 28 on horizontal axle 14. A counterweight 30 is adjustably secured to he end of horizontal axle 14 opposite centrifuge head 12. A bearing 32 secures the relative position of horizontal axle 14 in yoke 16 while a corresponding bearing 34 on vertical axle 18 secures yoke 16 relative to vertical axle 18. Yoke gear 20 is mounted to yoke 16 so that rotation of yoke gear 20 is translated directly into a corresponding rotation of yoke 16. Vertical axle 18, on the other hand, is fixed so that yoke 16 rotates about vertical axle 18 while vertical axle 18 remains stationary.

Centrifuge head 12 includes three flexible conduits attached thereto, a blood conduit 35, a plasma conduit 37, and a red blood cell conduit 39. Whole blood 36 is introduced into centrifuge head 12 through blood conduit 35. Blood 36 is separated into plasma 38 and red blood cells 40. Plasma 38 and red blood cells 40 are taken away from centrifuge head 12 by a plasma conduit 37 and red blood cell conduit 39, respectively. The functioning of centrifuge head 12 will be discussed more fully with respect to the description of FIG. 2.

Rotation of centrifuge head 12 in a vertical orientation on the end of horizontal axle 14 is matched by the rotation of horizontal axle 14 in an horizontal plane about vertical axle 18 so that one complete rotation of centrifuge head 12 matches one complete rotation of yoke 16. Importantly, the matching of rotation rates between centrifuge head 12 and yoke 16 means that the net rotation of conduits 35, 37, and 39 is zero thereby eliminating any requirement for bearings or rotating seals in centrifuge head 12. Conduits 35, 37, and 39 are directed upwardly to a centrally disposed connector apparatus (not shown) which handles whole blood 36, plasma 38, and red blood cells 40. This central location means that conduits 35, 37, and 39 circumscribe a generally circular path around the periphery defined by the rotation of yoke 16. The corresponding or matching rotation of centrifuge head 12 cancels out any net twisting of conduits 35, 37, and 39.

Figure 2:
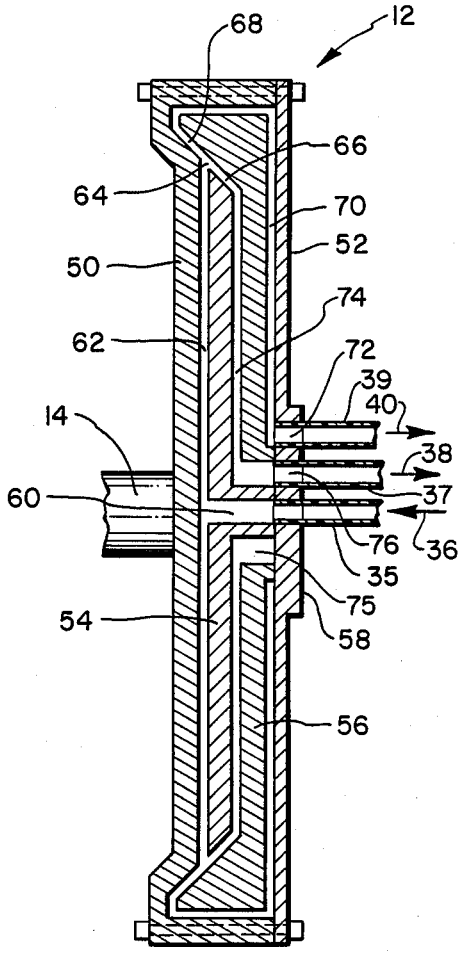
FIG. 2 is a cross sectional view of the centrifuge head taken along line 2—2 of FIG. 1.

Referring now more particularly to FIG. 2, centrifuge head 12 is shown in cross section to reveal its internal structure. Centrifuge head 12 includes an outer housing 50 mounted to the end of horizontal axle 14 and closed by a cover 52. Internally, centrifuge head 12 is segregated into flat, circular chambers including inlet or feed chamber 62, red blood cell chamber 70 and plasma chamber 74. Segregation of these chambers is accomplished by an inner disc 54 and an outer disc 56, the spaces around and between inner disc 54 and outer disc 56 forming the respective chambers. Inner disc 54 and outer disc 56 are each circular in configuration so that the respective chambers are also circular. Inner disc 54 and outer disc 56 are joined to cover 52 which is joined as an integral unit with outer housing 50 to form centrifuge head 12. A connector 58 on cover 52 serves as the connection point for conduits 35, 37, and 39.

Conduit 35 introduces whole blood 36 through an inlet 60 into feed chamber 62. Feed chamber 62 feeds whole blood 36 into an angled centrifuge chamber 64 which is configured as a truncated surface of a cone. Blood 36 is introduced into angled centrifuge chamber 64 near its mid point. Under centrifugation, the heavier fraction of blood 36 is separated out as red blood cells 40 by the centrifugal force imposed thereon and travels through centrifuge section 68 into red blood cell chamber 70. Correspondingly, the lighter fraction of whole blood 36 is separated as plasma 38 and travels through centrifuge section 66 into plasma chamber 74. The portion of red blood cell chamber 70 adjacent connector 54 includes a red blood cell coupling 72. The portion of plasma chamber 74 adjacent connector 54 includes a plasma plenum 75. Plasma plenum 75 is configured as an annular chamber to direct the flow of plasma 38 to coupling 76 to which conduit 37 is attached.

Centrifugation action inside centrifuge head 12 is significantly enhanced by the angular orientation of angled centrifuge chamber 64. Angled head centrifugation is known in the art and has been embodied in various configurations. Advantages include smaller rotor diameter and increased sedimentation rates at given rotor speeds. In particular, agglomeration of particles is accelerated since the horizontal component of the centrifugal force drives the particles toward the outer wall of angled centrifuge chamber 64 where they become agglomerated into a larger, effective particle size before moving under the vertical component of the centrifugal force toward the bottom of angled centrifuge chamber 64.

Mathematical Description

Figure 3:
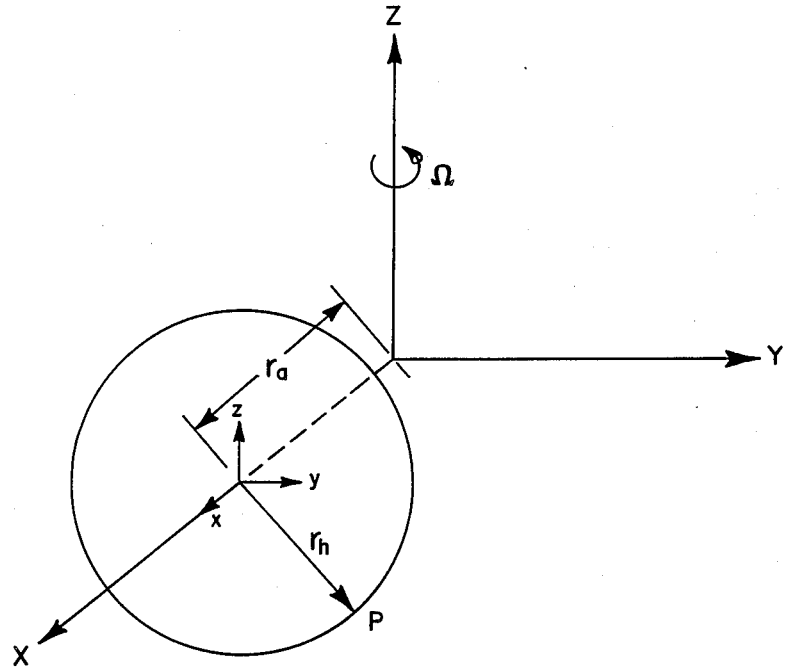
FIG. 3 is a schematic diagram for mathematically determining the forces in the centrifuge head.

Referring now to FIG. 3, the dual axis centrifuge head 12 rotates about its axis x with an angular velocity $\omega$. The center of centrifuge head 12 defines a reference frame x,y,z, which rotates about the Z axis with an angular velocity $\Omega$, in the X,Y plane. Point P on the head is where the particle sedimentation from the fluid occurs. The centrifugal force acting on the particle and fluid at point P is given by the buoyant mass of the particle times the absolute acceleration at that point.

Using vector notation the absolute acceleration $\vec{a}$ is given by:

$$\vec{a}=\vec{a}(X,Y,Z)+\vec{\Omega}\times\vec{r_h}+\vec{\Omega}\times(\vec{\Omega}\times\vec{r_n})+2\vec{\Omega}\times\vec{v_{rel}}+\alpha_{rel} \quad \text{Equation 4}$$

Where $$\vec{a}(X,Y,Z)=\vec{\Omega}\times(\vec{\Omega}\times\vec{r_a}),\ \vec{v_{rel}}=\vec{\omega}\times\vec{r_h},\ \vec{\alpha_{rel}}=\vec{\omega_x}\ \vec{r_h}), \quad \text{Equation 5}$$

$\vec{r_h}$="head" radius and $\vec{r_a}$="arm"radius. For our case $\vec{\Omega}=0$ since $\vec{\Omega}$=constant and $|\vec{\Omega}|=|\vec{\omega}|$ but must be kept separate for the vector calculation. rh and ra are the effective radii defining the position of the 'particle' anywhere in a thick head. For example, in the continuous flow head described here the equation would have to be solved for a series of points that define the separation channel.

The absolute acceleration and hence the centrifugal force varies in a complicated though periodic way in different parts of the head as it swings around the Z axis. For example, magnitude of the X component of the acceleration is given by $$|\alpha_x|=-\Omega^2 r_a\cos(\Omega t)+\Omega^2 r_h\sin(\Omega t)\sin(\Omega t)\sin(\omega t)+2\Omega r_n\cos(-\Omega t)\cos(\omega t) \quad \text{Equation 6}$$

The direction of the force relative to the separation channel also fluctuates as the head rotates. Thus one must carefully design the angled separation channel so that the force always causes sedimentation in the same direction in the sedimentation channel. It is possible to cause sedimentation in two directions if one is not careful.

The main advantage of the two axis centrifuge which warrants the more complicated design, is that a sealless, sterile, disposable centrifuge head 12 can be made which will allow for the continuous flow separation of red blood cells 40 from plasma 38. The counter rotation of the head, as it rotates about the Z axis, keeps the input and output tubing from twisting as the head rotates. Of course, the design also allows the connection of other conduits such as electrical connection to the head also without twisting during the centrifugation process.

Figure 4:
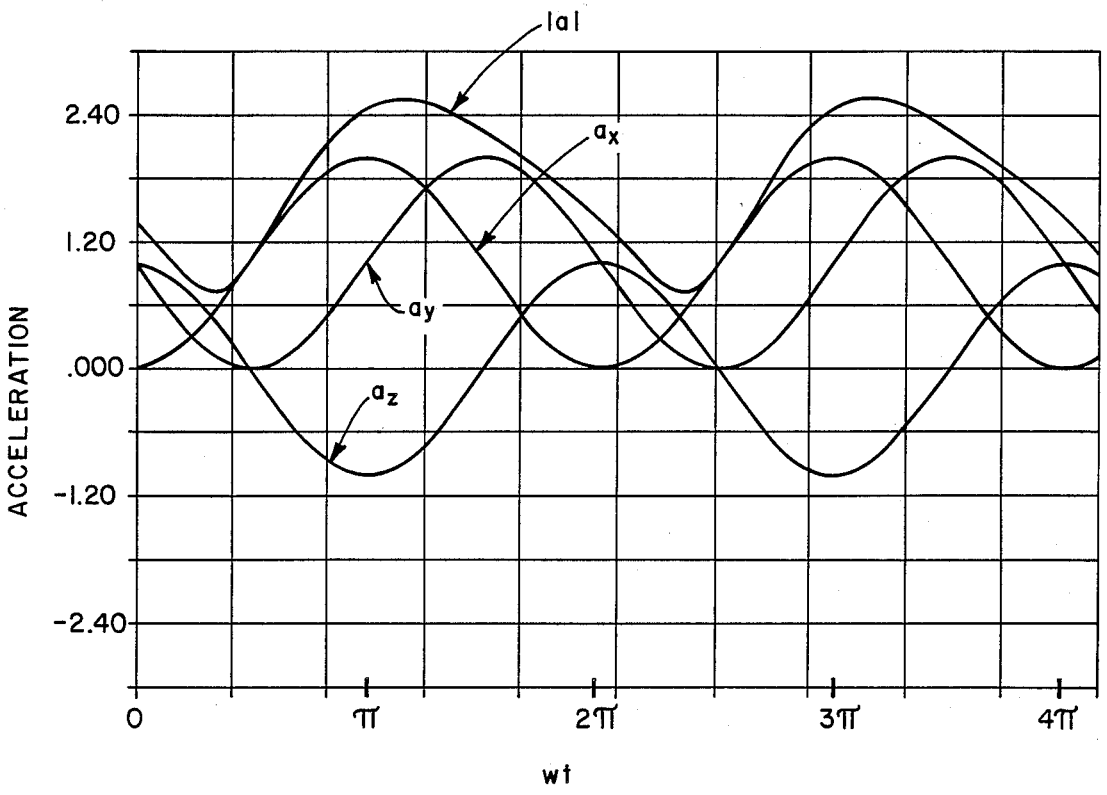
FIG. 4 is a graph illustrating the acceleration of various points as a function of the rate of rotation.

Referring now more particularly to FIG. 4, the pulsatile nature of the centrifugal forces caused by the respective acceleration component is shown. Equation 4 can be solved for $a_X$, $a_Y$, and $a_Z$. If $ra=r_h=1$ and $\omega=\Omega=1$ then:

$$\alpha_x=(1-\cos\omega t) \quad \text{Equation 7}$$

$$\alpha_y=(1-\sin\omega t)$$

$$\alpha_z=\cos\omega t$$

The magnitude of the pulsatile acceleration (and hence the centrifugal force) is $$|\alpha|=(\alpha_x^2+\alpha_y^2+\alpha_z^2)^{\frac{1}{2}}$$

FIG. 4 shows the nature of $a_X$, $a_Y$, $a_Z$ and the magnitude of $|a|$ the composite force, as the point P makes two revolutions (4 pi radians).

For an ordinary, one axis, centrifuge the acceleration component would not vary with $\omega t$ and would equal one unit. The dual axis centrifuge acceleration component fluctuates between about 2.5 and 0.7 units.

The Method

Continuous flow centrifugation is readily accomplished using the novel, dual axis, continuous flow centrifugation apparatus 10 of this invention. If blood is the liquid to be processed according to the teachings of this invention, an extracorporeal blood circuit (not shown) is coupled to whole blood conduit 35 to introduce blood 36 into centrifuge head 12. Correspondingly, plasma conduit 37 and red blood cell conduit 39 are also secured to the appropriate fittings on centrifuge head 12. Advantageously, all of the blood-contacting components inside centrifuge head 12 can be permanently attached to conduits 35, 37, and 39 and the entire unit can be made inexpensively so as to be completely disposable. This means that the entire extracorporeal blood circuit can be provided to the medical personnel in a presterilized condition so that it is only necessary to releasably secure centrifuge head 12 to the end of horizontal axle 14 and to suitably interconnect conduits 35, 37, and 39.

A motor (not shown) turns drive gear 22 so that drive belt 24 turns yoke gear 20 and yoke 16. Yoke 16 rotates about stationary vertical axle 18. Bevel gear 28 meshes with bevel gear 26 so that as yoke 16 turns about vertical axle 18 and its bevel gear 26, bevel gear 28 turns axle 14. The matching of bevel gear 26 with bevel gear 28 means that one full rotation of yoke 16 will be translated into one full rotation of centrifuge head 12. Twisting of conduits 35, 37, and 39 is thereby precluded.

Whole blood 36 passes through inlet 60 into feed chamber 62 where it is distributed into centrifuge chamber 64. Due to the angular orientation of centrifuge chamber 64 improved separation of whole blood 36 into plasma 38 and red blood cells 40 is achieved at lower rotation rates and in less time. Plasma 38 is removed through conduit 37 while red blood cells 40 are removed through conduit 39.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A dual axis, continuous flow centrifugation apparatus comprising:

a centrifuge head comprising an outer, circular housing, a circular cover for the housing, the housing and cover enclosing a first, circular disc and a second, circular disc in spaced relationship so as to form thin, circular spaces between each of the housing, the first circular disc, the second circular disc, and the cover, the thin circular space between the housing and the first, circular disc forming a blood inlet chamber; the thin circular space between the first circular disc and the second, circular disc forming a plasma chamber; and the thin circular space between the second, circular disc and the cover forming red blood cell chamber, the outer periphery of the blood inlet chamber forming a centrifugation chamber in fluid communication between the plasma chamber and the red blood cell chamber;

a first, horizontal axle means attached to the centrifuge head for rotating the plate of the centrifuge head in a vertical orientation;

a second, vertical axle means rotatable about a vertical axis for rotating the first axle means in a horizontal plane thereby causing the centrifuge head to scribe a circular path about the second axle means;

coupling means rotatably coupling the first axle means to the second axle means, said coupling means matching the rotation of the first axle means with the second axle means so that one complete rotation of the second axle means is matched to one complete rotation of the first axle means;

a plurality of flexible conduits in fluid communication with the centrifuge head; and drive means for turning the second axle means about the vertical axis.

2. The centrifugation apparatus defined in claim 1 wherein the centrifugation chamber is configured as a truncate section of a surface of a right circular cone so as to provide an angled centrifuge head.

3. The centrifugation apparatus defined in claim 2 wherein the centrifuge chamber comprises an inlet into the truncated section positioned to impart a pulsatile force component to the centrifugal forces in the truncated section.

4. The centrifugation apparatus defined in claim 1 wherein the second, vertical axle means comprises a yoke rotatable about the vertical axis, the yoke rotatably supporting the first, horizontal axle means.

5. The centrifugation apparatus defined in claim 1 wherein the coupling means comprises a pair of matching bevel gears to assure that rotation of the first axle means exactly corresponds to rotation of the second axle means.

6. The centrifugation apparatus defined in claim 1 wherein the drive means comprises a first gear secured to the second, vertical axle means and a second drive gear engaged to the first gear.

7. A dual axis, continuous flow centrifugation apparatus comprising:

a first, vertical axle mounted nonrotatably to a surface and having a first bevel gear at the upper end of the vertical axle;

a yoke rotatably mounted to the first vertical axle, the yoke having a yoke gear mounted to a lower end;

a second, horizontal axle rotatably mounted to an upper end of the yoke so that rotation of the yoke about the first vertical axle rotate the second, horizontal axle including a second bevel gear meshed to the first bevel gear so that rotation of the second, horizontal axle about the first, vertical axle caused the second bevel gear to rotate the second, horizontal axle;

drive means for turning the yoke about the first vertical axle and including a drive gear engaged to the yoke gear;

a centrifuge head mounted at a first face to an end of the second, horizontal axle, said centrifuge head comprising an outer, circular housing, a circular cover for the housing, the housing and cover enclosing a first, circular disc and a second, circular disc in spaced relationship so as to form thin, circular spaces between each of the housing, the first circular disc, the second circular disc, and the cover, the thin circular space between the housing and the first, circular disc forming a blood inlet chamber; the thin circular space between the first, circular disc and the second, circular disc forming a plasma chamber; and the thin circular space between the second, circular disc and the cover forming a red blood cell chamber, the outer periphery of the blood inlet chamber forming a centrifugation chamber in fluid communication between the plasma chamber and the red blood cell chamber; and a plurality of flexible conduits connected in fluid communication to the centrifuge head at a second face.

8. The centrifugation apparatus defined in claim 7 wherein the centrifugation chamber is configured as a truncated section of a surface of a right circular cone so as to provide an angle centrifuge head.

9. The centrifugation apparatus defined in claim 8 wherein the centrifuge chamber comprises an inlet into the truncated section positioned to impart a pulsatile force component to the centrifugal forces in the truncated section.

10. A method for providing faster separation of components in a liquid medium during continuous flow centrifugation comprising:

preparing a centrifuge head having a flat, circular inlet chamber, an angled centrifuge chamber at the outer periphery of the inlet chamber, the centrifuge chamber having a relatively thin cross section and being configured as a truncated surface of a right circular cone having an outer periphery and an inner periphery with the inlet chamber interconnecting to the centrifuge chamber adjacent the midsection of the centrifuge chamber, a red blood cell chamber in fluid communication with the outer periphery of the centrifuge chamber, and a plasma chamber in fluid communication with the inner periphery of the inner periphery of the centrifuge chamber;

mounting a flexible, plasma conduit to the centrifuge head in fluid communication with the plasma chamber, and a flexible, red blood cell conduit to the centrifuge head in fluid communication with the red blood cell chamber;

securing the centrifuge head to a rotatable, horizontal axle; and rotating the horizontal axle in an horizontal plane while turning the horizontal axle to rotate the centrifuge head in a vertical orientation while matching each rotation of the centrifuge head with each rotation of the horizontal axle in the horizontal plane thereby precluding twisting of the whole blood, plasma, and red blood cell conduits.

11. The method defined in claim 10 wherein the rotating step comprises mounting a vertical axle to a surface and rotatably securing a yoke to the vertical axle, the yoke rotatably supporting the horizontal axle and interconnecting the horizontal axle to the vertical axis with matching bevel gears so that each rotation of the horizontal axle in an horizontal plane about the vertical axle is matched by a rotation of the centrifuge head on the horizontal axle thereby precluding said twisting.

12. The method defined in claim 10 wherein the preparing step including introducing whole blood into the centrifuge chamber and imposing a pulsatile centrifugal force component on the blood by rotating the centrifuge head about the horizontal axis while rotating the horizontal axis about the vertical axis.

* * * * *